US006620009B1

(12) United States Patent
Jermyn

(10) Patent No.: US 6,620,009 B1
(45) Date of Patent: Sep. 16, 2003

(54) METHOD OF MAKING SELECTIVE MULTIPLE CONTOUR HIGH EFFICIENCY SWIM FINS

(75) Inventor: Richard A. Jermyn, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/127,151

(22) Filed: Apr. 22, 2002

(51) Int. Cl.[7] ..... A63B 31/08
(52) U.S. Cl. ..... 441/64
(58) Field of Search ..... 441/64

(56) References Cited

U.S. PATENT DOCUMENTS 4,819,529 A * 4/1989 Loriot ..... 83/32
5,417,599 A * 5/1995 Evans ..... 441/64
5,527,197 A * 6/1996 Evans ..... 441/64
5,615,922 A * 4/1997 Blanchard ..... 296/37.6

FOREIGN PATENT DOCUMENTS

GB 2 228 967 * 12/1990

* cited by examiner

*Primary Examiner*—Sherman Basinger
(74) *Attorney, Agent, or Firm*—Harvey A. Gilbert; Donald G. Peck

(57) ABSTRACT

A method of modifying operational characteristics of a swim fin makes existing fins adaptable to different users and/or operational needs. An existing swim fin having a blade portion extending from a body portion is placed on a flat work surface. The blade portion is made from a rubber-like material, and a template is laid on it. The outline of the template is traced onto the blade portion to define shape lines on it. The rubber-like material is removed from within the shape lines on the blade portion of the swim fin. The shape lines and the removed rubber-like material extend from a trailing edge of the blade portion toward the body portion. The method of the invention can readily modify and/or customize the fin's contours according to the user's needs or desires concerning fit, comfort, energy use, mission requirements and/or aesthetics.

10 Claims, 3 Drawing Sheets

10'

METHOD OF MAKING SELECTIVE MULTIPLE CONTOUR HIGH EFFICIENCY SWIM FINS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to fins used by swimmers for propulsion. More particularly, this invention is to a method of improving existing swim fins to make them more efficient.

Conventional swim fins have been manufactured in the past and present in typical set sizes such as "small", "medium", "large" and the like. Consequently, the user has been very limited in being able to choose a combination of overall features of the swim fins themselves but instead, has been generally required to select fins based upon the closest fit according to the user's foot size. In other words, the "foot" or "fin size" fixed every dimension and dynamic characteristic of the fin having that size selection. As the "foot" size dimension from fin to fin increased from say medium to large, then generally every contour and dimension of the fin also increased from fixed medium size to fixed large size. Thus, a user would not necessarily be able to choose a fin that would both simultaneously fit with comfort and also provide the desired hydrodynamic efficiency, size & shape for different tasks, and/or aesthetics. In this context, hydrodynamic efficiency may also be taken to mean hydrodynamic suitability (inefficiency) or resistance because it may be desired for example for fins to have increased inefficiencies and/or resistances for the purposes of exercise or training.

Many different hydrodynamic contours are possible in conventional fins and these contours may differ either greatly or only slightly from one another. However, the contours for swim fins have been fixed for given fin sizes, and these contours include contours of overall exterior/outermost surface outlines (exterior wings, paddles or individual blades), contours of surface features (ridges, bumps, indentations, stiffeners), contours of interior (passages, tunnels, vents or ports), and contours of foot openings (foot pockets or full foot enclosures). All of these contours control or affect hydrodynamic efficiency of fins to one degree or another as a result of fluid flow over the fin contours, or as a result of the mechanical flexure/rigidity which is a direct consequence of the combined contours (geometry) and material properties of the fins.

Thus, in accordance with this inventive concept, a need has been recognized in the state of the art for a method of reconfiguring existing swim fins for individual users to provide fit, comfort, energy use (in terms of efficiency of hydrodynamic design), requirements for different missions or aesthetics.

OBJECTS AND SUMMARY OF THE INVENTION

An object of the invention is to provide a method to reconfigure existing swim fins to modify hydrodynamic performance.

Another object of the invention is to provide a method of shaping existing swim fins to accommodate the needs of a user.

Another object of the invention is to provide a method of modifying existing swim fins to provide the additional and different capabilities of a large number of different swim fins without requiring an inventory of a commensurate large number of different swim fins.

Another object of the invention is to provide a cost-effective method of reshaping contours of existing swim fins to newer and more hydrodynamicly efficient modern designs.

Another object of the invention is to provide a method of selectively reshaping, or customizing existing swim fins that can be implemented at the time of sale to modify the hydrodynamic characteristics of the fins according to a buyer's needs.

These and other objects of the invention will become more readily apparent from the ensuing specification when taken in conjunction with the appended claims.

Accordingly, the present invention is to a method of reshaping existing diving fins according to a user's needs. An existing swim fin having a blade portion made from a rubber-like material extending from a body portion is placed on a flat work surface. A template is laid on the blade portion, and the outline of the template is traced onto the blade portion to define shape lines on it. The rubber-like material is removed from within the shape lines on the blade portion of the swim fin. The shape lines and the removed rubber-like material can extend from a trailing edge of the blade portion toward the body portion. Other contours are similarly formed in the swim fin since the method of the invention can readily modify and/or customize the fin's contours according to the user's needs or desires concerning fit, comfort, energy use, mission requirements and/or aesthetics.

DESCRIPTION OF THE PREFERRED EMBODIMENTS

Figure 1C:
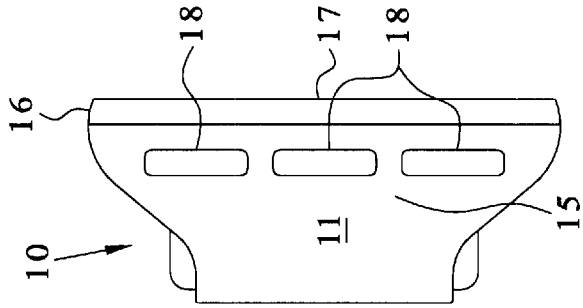
FIG. 1C (PRIOR ART)
FIGS. 1A, 1B, and 1C are schematic top/bottom, side, and end views of a first typical conventional swim fin of the prior art.
Figure 1A:
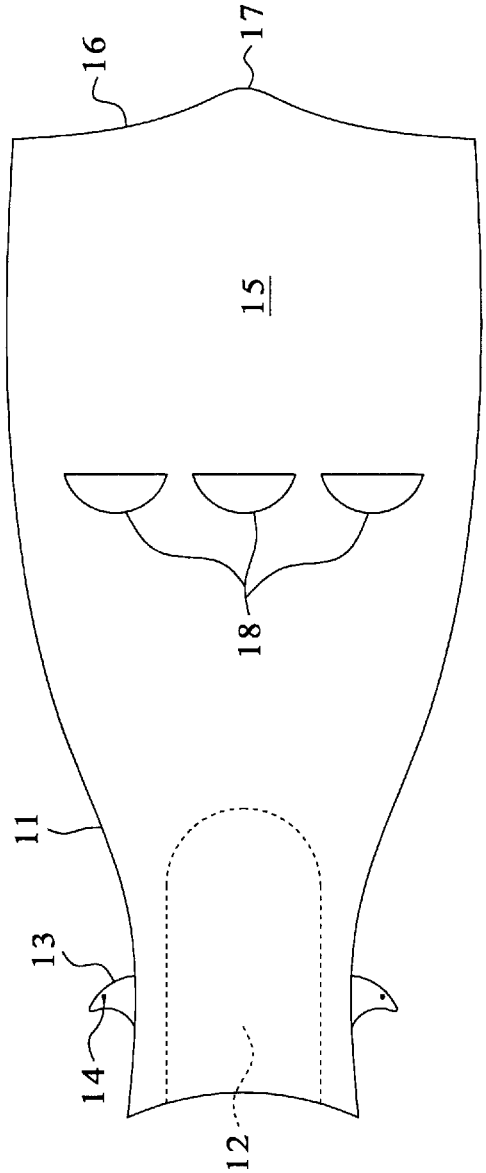
FIG. 1A (PRIOR ART)
Figure 1B:
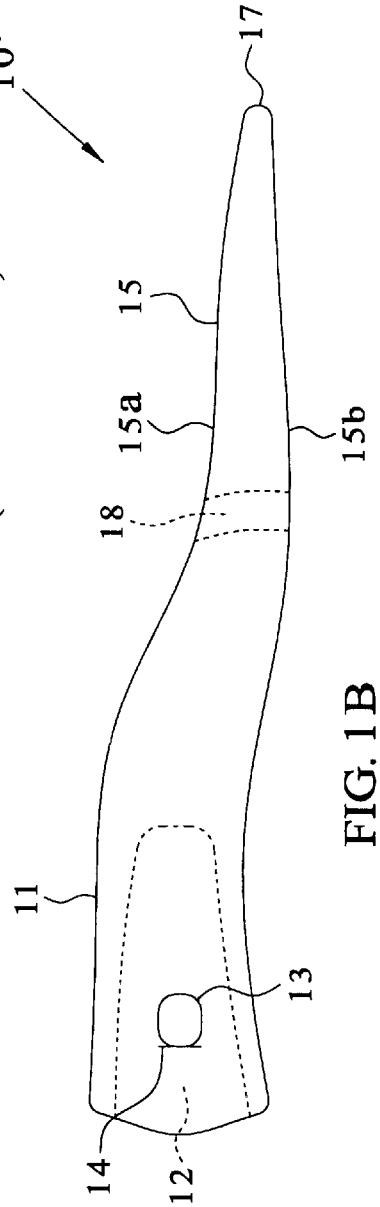
FIG. 1B (PRIOR ART)
Figure 3C:
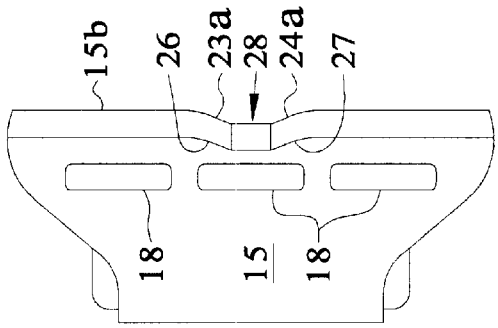
FIGS. 3A, 3B, and 3C are schematic top/bottom, side, and end views of the swim fin of FIGS. 1A, 1B, and 1C modified in accordance with the method of the invention.
Figure 2:
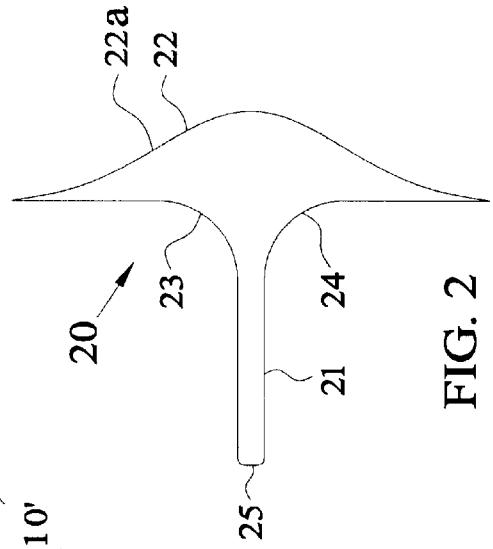
FIG. 2 is a schematic top view of a template for modifying the swim fin of FIGS. 1A, 1B, and 1C in accordance with the method of the invention.
Figure 3A:
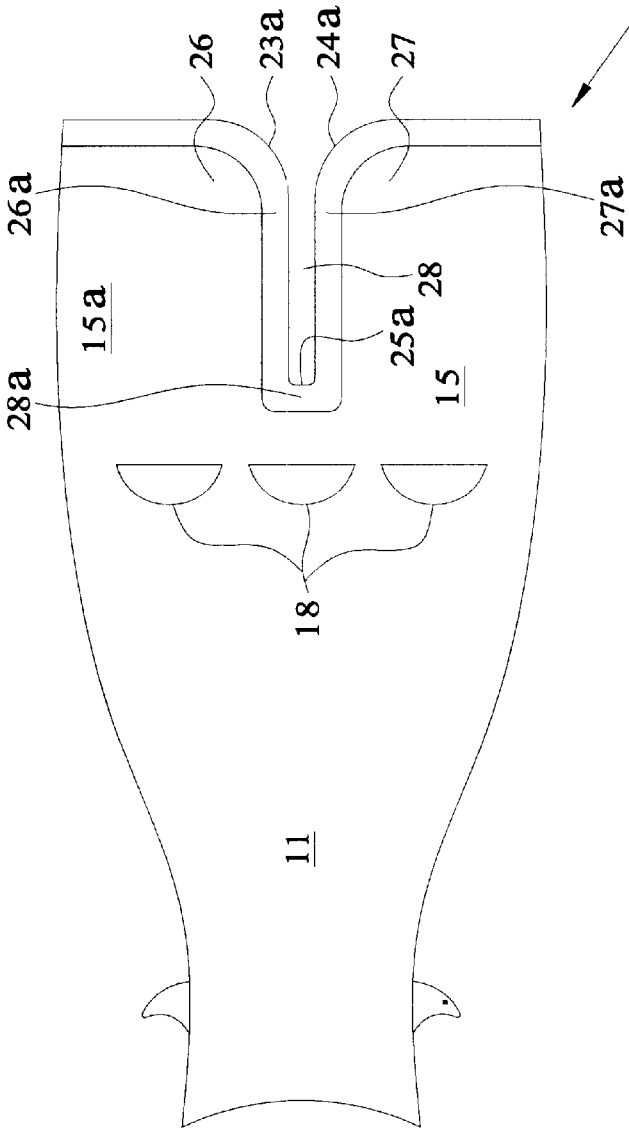
Figure 3B:
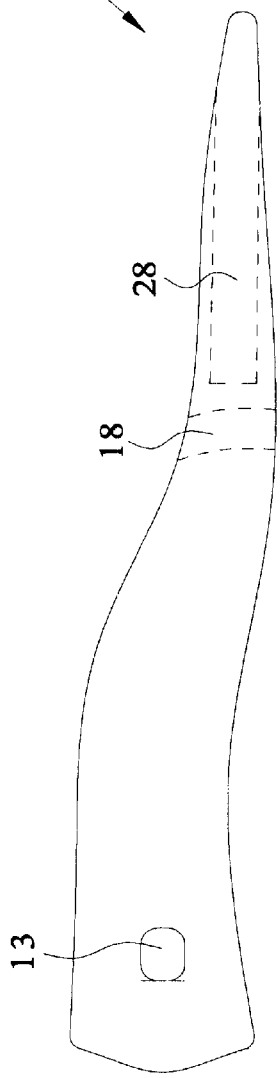

Referring to FIGS. 1A, 1B, and 1C, a typical prior art swimming fin 10 is depicted for propelling a swimmer through the water. The conventional design of swim fin 10 has a body portion 11 provided with a hollowed-out foot pocket 12 sized to receive a divers foot. Body portion 11 has a strap mounting structure 13 on opposite sides, and each strap mounting structure 13 has at least one pin 14 to receive a strap (not shown). Strap can be wrapped about pins 14 and the foot of a diver and be tightened in such a fashion as to secure each swim fin 10 on the foot as the diver swims through the water.

Body portion 11 has a blade portion 15 having a tapering cross section that extends from body portion 11 to a trailing edge 16 that ends in a centrally located rounded tip 17. Tapering blade portion 15 has a number of traverse flow passages, or ports 18 that reach between top surface 15*a* and bottom surface 15*b* of tapered blade portion 15 to vent some water through them as each fin 10 is moved through the water.

Conventional swim fin 10 usually is molded from a sufficient quantity of rubber-like material that can be rubber, some flexible plastic and/or fiberglass structures and related rubber-like compounds that may or may not requiring curing to reach its final form. Whatever material is chosen, swim fin 10 is relatively large and heavy to have the stiffness and flexibility to hydrodynamicly interact with the ambient water to push a well-developed diver through the water. Since larger sizes of such fins have conventionally been made bigger, and consequently, even thicker and heavier, the weight and stiffness of such fins can contribute to bring on dangerous levels of fatigue, particularly in colder waters. These levels of fatigue are more likely to affect a very capable, yet less developed diver that has a large foot size and consequently must use the larger, more massive fins.

Referring to FIG. 2 and FIGS. 3A, 3B, and 3C, a template 20 is made to help modify conventional swim fin 10 of FIGS. 1A, 1B, and 1C into an improved swim fin 10' by modification of its contours. Template 20 has an elongate tapered stem part 21 that gradually increases its lateral dimension into an elongate rounded cross-part 22 that has its outer rounded surface 22*a* shaped to conform to the shape of trailing edge 16 and central rounded tip 17 of swim fin 10. Template 20 can be made from a flat sheet of material, such as plastic or metal, or it can be made of cardboard or paper, if desired.

Swim fin 10 is placed on a flat work surface with either top surface 15*a* or bottom surface 15*b* of blade portion 15 up. Template 20 is laid on top surface 15*a* and/or bottom surface 15*b* of swim fin 10 with elongate rounded cross part shape 22 lying on top of trailing edge 16 and central rounded tip 17 of swim fin 10. Curved shapes 23 and 24 and width shape 25 defined by template 20 are traced by a pencil or similar marking device to mark curved shape lines 23*a* and 24*a* and width shape line 25*a* onto top surface 15*a* and/or bottom surface 15*b* of blade portion 15 of swim fin 10. After template 20 is removed from swim fin 10, the material of swim fin 10 within shape lines 23*a*, 24*a* and 25*a* (and rounded surface 22*a* of cross part shape 22) is removed. The unwanted/undesired fin material within the lines can be removed in several ways by cutting, sawing, shearing, tearing, grinding, disconnecting or melting etc.

Removal of the material forms rounded trailing surfaces 26 and 27 having an elongate slot 28 between them that extends almost to one of traverse flow ports 18. Optionally, inclined, or beveled surfaces or lips 26*a*, 27*a* and 28*a* can be formed adjacent to and along the edges of rounded trailing surfaces 26 and 27 and adjacent to the end of slot 28.

Figure 4C:
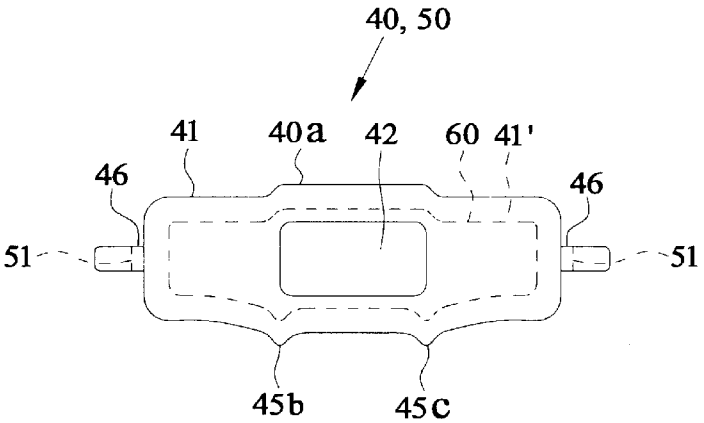
FIGS. 4A, 4B, and 4C are schematic top/bottom, side, and end views of another conventional swim fin of the prior art and dashed lines thereon show modified contours made in accordance with the invention.
Figure 4A:
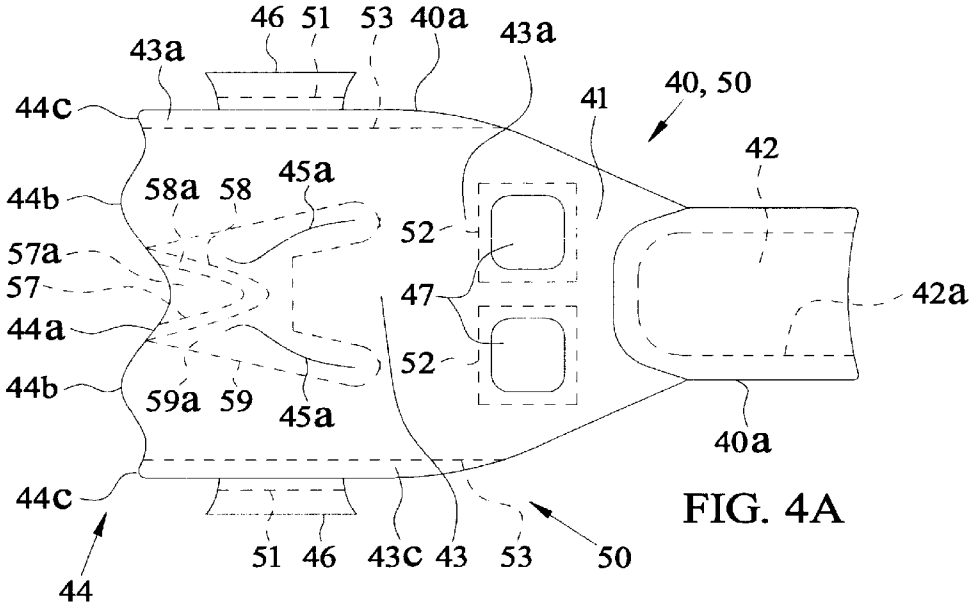
Figure 4B:
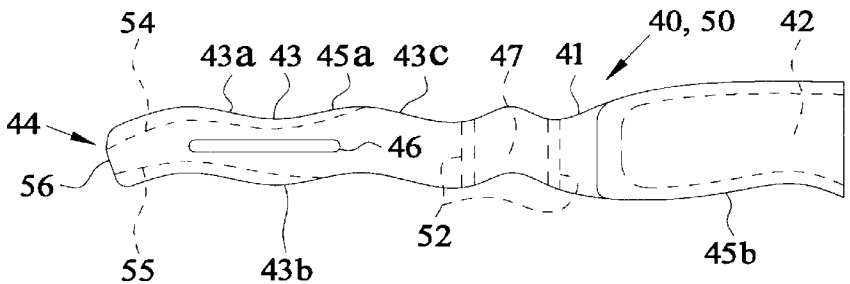

Another typical existing swim fin 40 of the prior art is shown in FIGS. 4A, 4B, and 4C, and is generally known as a high efficiency swim fin design that can be modified in accordance with this inventive concept to increase its usefulness. Though similar to the prior art fin 10 described above, it has additional features for modification by this inventive concept to improve its capabilities and functional usefulness.

This conventional swim fin 40 has an outer shape as shown by solid line 40*a* around a body portion 41 having a hollowed-out foot pocket 42 sized to receive a diver's foot. Straps and mounting structures can be the same as described above or a full foot enclosure can be used instead of foot pocket 42 to hold the fin on the diver's foot during swimming.

Body portion 41 has a blade portion 43 having an essentially serpentine-shaped cross-sectional configuration extending from body portion 41 to an irregular trailing edge 44. Top ridges 45*a* on the top surface 43*a* of blade portion 43 and bottom ridges 45*b* and 45*c* on the bottom surface 43*b* of body portion 41 and/or blade portion 43 increase stiffness of swim fin 40. Trailing edge 44 of blade portion 43 has a shallow central recessed part 44*a* having rounded projecting parts 44*b* on opposite sides and pointed end parts 44*c* at opposite ends. Elongate wings 46 are molded with or mounted on opposite sides of blade portion 43 for additional thrust. Blade portion 43 also has flow ports 47 that extend through blade portion 43 and body portion 41 to vent some water through them as a diver moves each fin 40 through the water.

Swim fin 40 can be molded from a rubber-like material as described above in sufficient quantities to have sufficient lasting strength to propel a diver through the water. Since larger sizes of conventional fins such as this are simply made bigger, and consequently, thicker and heavier, the weight and stiffness of such fins can bring on dangerous levels of fatigue for some divers, particularly in turbulent, and otherwise harsh ambient conditions.

Swim fin 40 can be made into modified swim fin 50 by changing the contours of swim fin 40 to create different thrust or other hydrodynamic characteristics for different divers or different training/task scenarios. Modified swim fin 50 can have elongate wings 46 removed by cutting them from blade portions 43 along the contours defined by cut-off edges 51. This removal of elongate wings 46 along cut-off edges 51 will reduce the effort required to move modified fin 50 and also reduce the drag and thrust that were associated with elongate wings 46. Modified swim fin 50 can have flow ports 47 in blade portion 43 enlarged by removing material of blade portion 43 along the contours defined by cut-off edges 52. This removal of part of the rubber-like material of blade portion 43 along cut-off edges 52 will further reduce the effort required to move modified fin 50.

Modified swim fin 50 can also have longitudinally extending parts 43*c* on opposite lateral sides of blade portion 43 removed along the contours defined by cut-off edges 53. This removal of parts 43*a* to the outside of cut-off edges 53 will reduce the effort required to move modified fin 50. This removal also reduces the drag and thrust associated with the material of a complete, unaltered blade portion 43 as well as any ridges or other additional stiffening structure that may have been within the regions of parts 43*a* that were cut off.

The contours of blade portion 43 can be further modified by cutting away the material of its serpentine-shaped cross-sectional configuration that is above cut-off edge 54 and below cut-off edge 55. This leaves reduced cross-sectional serpentine-shaped portion 56 between cut-off edges 54 and 55 that has reduced thickness and volume as compared to the unmodified serpentine-shaped cross-sectional configuration. Serpentine-shaped portion 56 has less stiffness, and also since there is less mass to displace, even less effort is needed to move such a modified fin 50.

In addition the reshaping of contours as described above, different templates having different shapes as compared to template 20 described above can be fitted onto modified swim fin 50, or unmodified swim fin 40 and traced on it, and the rubber-like material within the trace lines can be removed. The different slots defined by the different templates will have different amounts of material cut away from blade portion 43.

FIG. 4A shows an outer trace shape line 57 of a relatively narrow and shallow first slot 57*a* that is produced at trailing edge 44 of fin 50 when the material of blade portion 43 within outer trace shape line 57 is removed. This fin modification will reduce the force required to move it. FIG. 4A additionally shows another outer trace shape line 58 of a larger and deeper second slot 58*a* that is produced at trailing edge 44 when the material of blade portion 43 within outer trace shape line 58 is removed. Since the fin having second slot 58*a* has more material removed, less force will be needed to move such a modified fin as compared to a fin shaped with slot 57*a*. FIG. 4A shows still another outer trace shape line 59 of a third still larger and deeper twin-lobed slot 59*a* that is produced at trailing edge 44 when the material of blade a portion 43 within outer trace shape line 59 is removed. Since the fin having twin lobed slot 59*a* has still more of the material removed in twin-lobed slot 59*a* at trailing edge 44 than either of slots 57*a* and 58*a*, still less force will be needed to move such a modified fin. The three modified fins having slots 57*a*, 58*a*, and 59*a* of material of blade portion 43 removed may further change their hydrodynamic properties by including the modifications associated with cut-off edges 51, 52, 53, 54 and 55.

Referring to FIG. 4C, a further option for modifying a fin has a reduction of the entire outer dimension of body portion 41 (outlined by solid line 40*a*) and material defining its foot pocket 42 to a body portion 41' (outlined by cut-off edge 60). This all around reduction of the rubber-like fabrication material from body portion 41 and from other portions described above, further reduces stiffness and mass to additionally change the hydrodynamic properties of a fin so modified.

Figure 5:
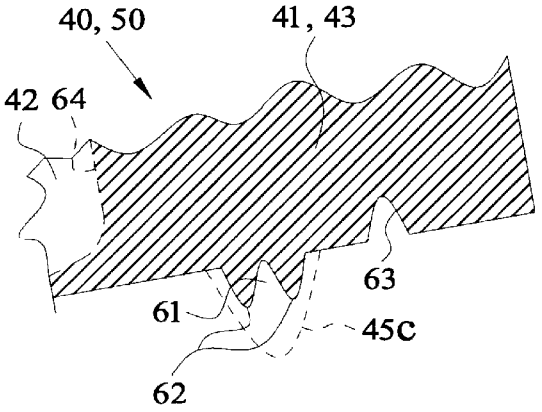
FIG. 5 is an enlarged cross-sectional view of the fin of FIGS. 4A, 4B, 4C showing modification of lower ridge structure and addition of a groove.

FIG. 5 is an enlarged showing of another modification of fin structure of FIG. 4C that has parts of the material in elongate ridges on the bottom of body portion 41 and blade portion 43 cut away. Only one such elongate ridge 45*c* is depicted in the partial cross-sectional view of fin structure in FIG. 5, and elongate ridge 45*c* can extend forward on the bottom of body portion 41 and blade portion 43. Ridge 45*c* has its mass and stiffness reduced by cutting away material in it and making a forwardly extending smaller groove 61 between smaller ridges 62. Another groove 63 can also be cut into the bottom of body portion 41 and blade portion 43 to extend at least some distance forward to further reduce the mass and stiffness. More of such grooves 61 and 63 can be cut in other ridges and flat expanses to selectively remove more fabrication material and consequently change a fin's contours, mass, and operational parameters. Hollowed-out pocket 42 can have its volume increased by cutting away a part of the rubber-like material of body portion 41 to a cut-off edge line 64 to reduce stiffness and make the fin larger to fit a larger foot. Furthermore, all of the fins modified in accordance with the invention can also have beveled edges along the cut-off edges 51, 52, 53, 54, and 55 and the cuts made along the outer trace shape lines 57, 58, and 59, as well as other edges as desired.

It is understood that the fins that are being modified in accordance with this invention were initially made to a large, standard, anticipated size and/or provided with ample material such that fin material will not be required to be added. The removal of fabrication material along the selective contours as described above has the effect of modifying contours of overbuilt fins, creating new contours, or a combination of both of these. Removal of material along selective contours according to this invention can shorten a blade, modify a blade shape, add an additional blade, remove or add a wing, add or modify a flow passage (port) or resize material around a foot pocket. The unwanted/undesired fin material that is to be removed or other modifications can be done in several ways such as by cutting, sawing, shearing, tearing, grinding, disconnecting, or melting etc.

Although creating some contours having specific shapes has been described, the selective contours can be added to existing or future swim fins in several ways. For example, the description related to FIG. 5, has described one way to incorporate groove 63 along the surface of As body portion 41 of a fin or groove/space 61 between two raised ridges 62 along the surface of the fin as an exemplary showing. In addition, by cutting groove 61 on a ridge the two smaller ridges 62 can be said to have a selective contour having a more finished appearance. These examples will enable a user to be able to select and follow these procedure to create contour line(s) and then subsequently remove the excess/unneeded material along the selected contour line(s).

The identification/marking/selection of the method of the invention gives the capability for modifying an existing swim fin having given hydrodynamic contours with efficiency inherent to or associated with those contours. The method of the modification of the invention enables ready selection, modification and/or customizing of the fin's contours according to the user's needs or desires.

The method of modification of the invention makes a large number of customized swim fins available without requiring a substantial number of fins in inventory. Existing swimming fins can have their hydrodynamic efficiencies changed to embrace the capabilities of newer and more improved modern designs by simply reshaping the existing fins according to new selective contours. This change can be accomplished at little additional cost. The invention also allows swim fins to be customized at the time of customer need/purchase either by the manufacturer or his representative (dealer) at the time of sale or by a user at a later time according to his/her own convenience.

Having the teachings of this invention in mind, modifications and alternate embodiments of the method of this invention may be adapted without departing from the scope of the invention. Its uncomplicated procedure for modifying existing swim fins allows selected contours on its opposite lateral sides to cross one another and thus give an even wider variety of finished characteristics. The selected contours may be marked by lines on the opposite sides and may extend either continuously or intermittently to define extending ridges/grooves made adjacent to one another in single or multiple ridges and/or grooves. Some of the selected contours can also be made to extend as broken lines or by perforations in the fabrication material. The selected contours can be made with templates or added per supplied geometric instructions, and modifications of the selected contours may be embedded as visible/contrasting colors. Fasteners, attachment points, snaps, or grooves, etc., and contours may be selected and added after manufacture.

The disclosed components and their arrangements as disclosed herein, all contribute to the novel features of this invention. The method of modification of existing swim fins of the invention provides a cost-effective way to meet the different requirements created by different users under different operational scenarios. Therefore, the method of modification of existing swim fins, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

I claim:

1. A method of modifying the characteristics of a swim fin comprising the steps of:

placing a swim fin having a blade portion extending from a body portion on a flat work surface, said swim fin being made from a rubber-like material;

laying a template on said blade portion;

tracing the outline of said template on said blade portion to define shape lines thereon; and removing said rubber-like material from within said shape lines on said blade portion, wherein said shape lines and the removed rubber-like material extend from a trailing edge of said blade portion toward said body portion.

2. The method of claim 1 further comprising the step of:

removing said rubber like material from longitudinally extending parts of said blade portion from its opposite lateral sides.

3. The method of claim 2 further comprising the step of:

enlarging flow ports in said blade portion by removal of some said rubber-like material from said blade portion.

4. The method of claim 3 further comprising the step of:

cutting away said rubber-like material of said blade portion to reduce its cross-sectional thickness and volume.

5. The method of claim 4 herein said reduced cross-sectional thickness and volume has a serpentine-shaped cross-section.

6. The method of claim 5 further comprising the step of:

cutting away a part of rubber-like material of said body portion to increase volume of a hollowed-out pocket to fit a larger foot.

7. The method of claim 6 further comprising the step of:

cutting at least one groove in the bottom of said body portion and said blade portion to reduce mass and stiffness.

8. The method of claim 7 further comprising the step of:

cutting away rubber-like material in each elongate ridge extending forward on said bottom of said body portion and said blade portion to make a forwardly extending smaller groove between smaller ridges to reduce mass and stiffness.

9. The method of claim 8 further comprising the step of:

providing beveled edges along cut-off edges and the cuts made along outer trace lines.

10. The method of claim 9 further comprising the step of: cutting elongate wings from opposite sides of said blade portion.

* * * * *